United States Patent [19]

Yasutome et al.

[11] 4,045,702

[45] Aug. 30, 1977

[54] FLUORESCENT CHARACTER INDICATING TUBE

[75] Inventors: Osamu Yasutome, Taishi; Mitsuo Takeda, Tokyo, both of Japan

[73] Assignee: Tokyo Shibaura Electric Co., Ltd., Tokyo, Japan

[21] Appl. No.: 697,461

[22] Filed: June 18, 1976

[30] Foreign Application Priority Data

June 18, 1975 Japan ..... 50-73876

[51] Int. Cl.[2] ..... H01J 1/72; H01J 63/06

[52] U.S. Cl. ..... 313/496; 313/217

[58] Field of Search ..... 313/496, 497, 495, 517, 313/519, 217

[56] References Cited

U.S. PATENT DOCUMENTS

| | | | |
|---|---|---|---|
| 3,589,789 | 6/1971 | Hubert et al. | 313/485 X |
| 3,786,295 | 1/1974 | Fujii et al. | 313/517 |
| 3,787,940 | 1/1974 | Kupsky | 29/25.16 |
| 3,906,269 | 9/1975 | Tanji | 313/496 |

*Primary Examiner*—Palmer C. Demeo

*Attorney, Agent, or Firm*—Oblon, Fisher, Spivak, McClelland & Maier

[57] ABSTRACT

A fluorescent character-indicating tube wherein a plurality of coplanar anode elements are arranged on a base plate in a predetermined form so as to indicate some indicia and at least one elongate filament for generating electrons to the anode elements.

The anode element comprises an anode electrode segment and a phosphor segment. The anode electrodes are printed on the base plate. The phosphor material is disposed on the entire surfaces of the anode electrode segment by a process of electrodeposition.

4 Claims, 3 Drawing Figures

FLUORESCENT CHARACTER INDICATING TUBE

BACKGROUND OF THE INVENTION

1. Field of the Invention

This invention relates to the improvement of a fluorescent character-indicating tube wherein a plurality of co-planar anode segments are arranged in a predermined form and more specifically to an improved tube of the character described having an improved structure of the anode segments.

2. Description of the Prior Art

A fluorescent character-indicating tube is generally used for the display of an electronic calculator, and presently, so called multi-digit type fluorescent character-indicating tubes are popularly used. In a multi-digit type tube, a plurality of co-planar digit elements are arranged on a base plate. One digit element includes a plurality of anode segments arranged in a predetermined form on a base plate.

There are two methods for making the anode segment structure of this type tube.

One is to use a base plate in which a plurality of grooves are arranged so as to indicate some indicia, and a phosphor material is disposed in it by a process of sedimentation. Of course, before this step, an anode electrode segment is arranged on a bottom surface of a groove. This grooved base plate type structure is advantageous to obtain a sharply outlined anode segment. However, it requires rather complex steps and many parts to form such a grooved base plate with anode electrodes in it.

For avoiding these complex structure and reducing manufacturing costs the other method, that is. The printing method is preferred. In this case, both anode electrode segments and phosphor segments are arranged by a screen printing process, respectively. According to this method, manufcaturing cost can be reduced. But another technical problem occurs in this printing method. That is printing or alignment differences between anode electrode segments and phosphor segments. This "shear"in printing is inevitable even if the same original screen pattern is used for printing both anode electrode segments and phosphor segments.

The amount of these differences in printing is generally about 130 to 300μ where the total printing length is about 60mm. Therefore, if the printing method is used, it is necessary to leave a space of at least about 400μ between the anode electrode segments. Consequently, this spoils the continuity of the digit pattern.

So in order to avoid this defect, in printing, it is presently proposed to make the phosphor segment smaller than the anode electrode segment for leaving a spacing tolerance. However, in doing so, the brightness of the tube is decreased because a fair number of electrons generated are attracted to the exposed surfaces of the anode electrode of which the electric potential is higher than the surface of the phosphor segment. Accordingly, decreased brightness appears particularly at the edge portions of the phosphor segment. Consequently it becomes impossible to obtain uniform brightness in indicated characters.

SUMMARY OF THE INVENTION

Accordingly, it is a general object of this invention to provie an improved fluorescent character indicating tube.

A more specific object of the invention is to provide a new and improved indicating tube with improved brightness of the indicated character.

It is a more specific object of this invention to provide a new and improved multi-digit type fluorescent character indicating tube with improved brightness, clearness and continuity of the indicated charcter.

It is another object of this invention to provide an improved character indicating tube with substantially reduced partial exfoliation of the phosphor segment.

A still further object of this invention is to provide an improved fluorescent character indicating tube in which a phosphor segment is deposited on the entire surface of an anode segment for improving the uniformity of the light output of the phosphor segment.

A fluorescent character indicating tube, constructed in accordance with the present invention, comprises witin an evacuated envelope an insulating base plate including, a plurality of lead circuits printed on the base plate, a thin insulating layer having a plurality of pin holes printed over the lead circuits, a plurality of co-planar anode elements being arranged on the insulating layer in a predetermined form, at least one elongate filament extending above the anode elements for generating electrons, each of said anode elements comprising an anode electrode segment printed on the insulating layer so as to locate on a pin hole of the thin insulating layer for electrically connecting to the lead circuit, the anode electrode segment having a certain height toward the filament, and a phosphor segment deposited over the entire surfaces of the anode electrode segment being projected on the insulating base plate.

BRIEF DESCRIPTION OF THE DRAWINGS

The features of this invention, which are believed to be novel, are set forth with particularity in the appended claims.

The invention, together with further objects and advantages thereof, maybe understood from the following detailed description taken in connection with the accompanying drawings, in the several figures of which like reference numerals identify like elements, and in which.

DESCRIPTION OF THE PREFERRED EMBODIMENT

Figure 1:
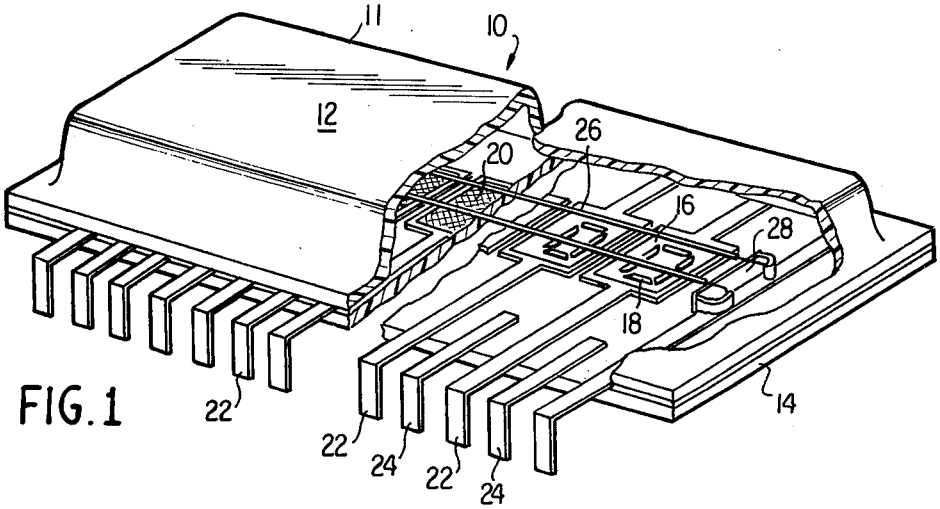
FIG. 1 is a perspective view, partly in section, of one embodiment showing in general certain of the basic components of a fluorescent character-indicating tube.

A fluorescent character-indicating tube comprises an evacuated envelope cover 11 including at least partially transparent viewing window 12 and a base plate 14 of an insulating material, such as glass or ceramic or the like. A plurlaity of digit elements 16 are arranged on the base plate 14, each of which includes a plurality of co-planar anode elements 18. A plurality of mesh control grids 20 are disposed above each of the digit elements 16 for controlling the location of an indicated digit. The plurality of mesh control grids 20 are electrically connected to individual outer leads 22. The plurality of the anode elements 18 are also electrically connected to individual outer leads 24. At least one elongate filament 26 is extended lengthwise of the base plate above the mesh grids 20 and is secured to the base plate by a pair of support members 28 which are located on both ends of the base plate 14.

Though FIG. 1 shows a flat envelope type tube including a plurality of digit elements, this invention is not limited to such a tube but is applicable to another type of tube, for example, a circular envelope type tube and a so-called one-digit indicating type tube or the like.

Figure 2:
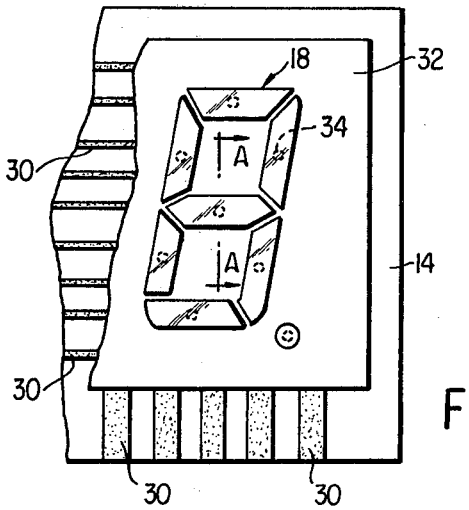
FIG. 2 shows a plan view, partly in section, of a preferred embodiment of the anode element structure shown in FIG. 1.

FIG. 2 shows a fragmentary plan view of the base plate and anode elements in FIG. 1.

A plurality of lead circuits 30 are printed on the base plate 14. The leads consist of an electroconductive material, such as an Ag-paste or the like. After printing and baking the lead circuits 30, a thin insulating layer 32 is coated over the lead circuits. The thin layer 32 ha a plurality of pin-holes 34 for connecting the anode electrode to the lead circuit 30. The thin insulating layer 32, which may be a solder glass or the like is also arranged by printing and baking. After that, anode elements 18 are arranged on the thin insulating layer 32.

Figure 3:
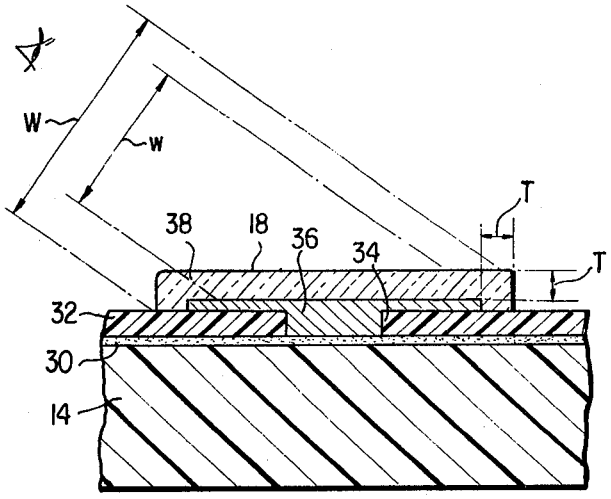
FIG. 3 is a sectional view of the anode element structure taken along the line A—A of FIG. 2 looking in the direction of the arrows.

The details of the anode element structure of the present invention will be explained by reference to FIG. 3 which is a sectional view of the anode structure 18 taken along the line A—A in FIG. 2. As mentioned above after printing the lead circuits 30, the thin insulating layer 32 is also printed over them. After baking the thin layer 32 a pluraity of anode electrode segments 36 arranged in a predetermined form are printed so as to be located on the pin holes 34 of the insulating layer 32. For example, the anode electrode comprises, graphite, water glass and some fillers. The anode electrode segment material fills in the pin holes 34 of the thin insulating layer 32 and the anode electrode segments are connected to the printed leads 30. According to this invention, a phosphor material 38 such as zinc oxide is disposed on all exposed surfaces of each anode electrode segment 36 which has a certain height toward the filament so as to project upon the surface of the thin layer 32.

In the present invention, the electrodeposition technique is used for disposing the phosphor material over the entire surfaces of the anode electrode segments. In this case, the anode electrode segments 36 are connected to the cathode of the battery and are dipped into an electrolyte of a phosphor material. To the anode of the battery, a platinum plate or rod is usually connected. By using the electrodeposition technique, the phosphor material 38 can be deposited so as to have substantially the same thickness along the entire surfaces of the anode electrode segment 36. That is, the phosphor segment 38 has the same thickness T on both the upper surface and the side surfaces of the anode electrode 36 as shown in FIG. 3.

According to the invented structure of the phosphor segment, increased brightness and the uniformity are simultaneously achieved. Furthermore, according to this invention, the large and smooth edged character segments are obtained. Especially, this is advantageous where the viewer looks at the fluorescent character indicating tube in a slanting direction. As shown in FIG. 3, the viewer can look at the larger charcter W as compared to the conventional anode segment structure w.

While only one embodiment of the invention have been illustrated and descrived, it is understood that various changes, modifications and alternations can be made without departing from the scope of the invention as set forth in the appended claims.

What is claimed is:

1. In a fluorescent character-indicating tube comprising an evacuated envelope including at least a partially transparent viewing window, an insulating base plate, a plurality of lead circuits printed on said base plate, a thin insulating layer having a plurality of pin holes printed on said lead circuits, a plurality of co-planar anode elements arranged on said insulating thin layer in a predetermined form, and at least one elongated filament positioned above said anode elements for generating electrons, improved anode elements, each comprising:

an anode electrode segment printed on said thin insulating layer so as to be located on at least one of said pin holes in said thin insulating layer for electrically connecting said anode electrode segment to said lead circuit, each said anode electrode segment having exposed top and side surfaces projecting from said thin insulating layer toward said filament; and, a phosphor layer being deposited over the entire extent of the exposed top and side surfaces of said anode electrode segment.

2. The fluorescent character-indicating tube of claim 1, wherein: said phosphor layer is deposited so as to have substantially the same thickness along the entire surface of said anode electrode segment.

3. The fluorescent character-indicating tube of claim 1, wherein: said phosphor layer is deposited by a process of electrodeposition.

4. The fluorescent character-indicating tube of claim 1, wherein said anode electrode segment comprises a graphite electrode.

* * * * *